US010504461B2

(12) United States Patent
Kim et al.

(10) Patent No.: US 10,504,461 B2
(45) Date of Patent: Dec. 10, 2019

(54) DISPLAY APPARATUS AND DISPLAY METHOD

(71) Applicant: Samsung Electronics Co., Ltd., Suwon-si, Gyeonggi-do (KR)

(72) Inventors: Soo-hong Kim, Seoul (KR); Young-mo Kang, Seoul (KR)

(73) Assignee: SAMSUNG ELECTRONICS CO., LTD., Suwon-si (KR)

( * ) Notice: Subject to any disclaimer, the term of this patent is extended or adjusted under 35 U.S.C. 154(b) by 36 days.

(21) Appl. No.: 15/856,446

(22) Filed: Dec. 28, 2017

(65) Prior Publication Data

US 2018/0190214 A1 Jul. 5, 2018

(30) Foreign Application Priority Data

Dec. 30, 2016 (KR) ..... 10-2016-0183759

(51) Int. Cl.
*G09G 3/20* (2006.01)
*G09G 3/36* (2006.01)
(Continued)

(52) U.S. Cl.
CPC ..... *G09G 3/3607* (2013.01); *G09G 3/006* (2013.01); *G09G 3/20* (2013.01); *G09G 3/2007* (2013.01);
(Continued)

(58) Field of Classification Search
CPC ... G09G 2320/0233; G09G 2320/0285; G09G 2320/029; G09G 2320/0693;
(Continued)

(56) References Cited

U.S. PATENT DOCUMENTS 9,602,792 B2 3/2017 Jeong et al.
2007/0091334 A1* 4/2007 Yamaguchi ..... H04N 9/3182 358/1.9
(Continued)

FOREIGN PATENT DOCUMENTS

GB 2543456 4/2017
JP 2007-279417 10/2007
(Continued)

OTHER PUBLICATIONS

International Search Report, PCT/ISA/210, dated Apr. 17, 2018, in corresponding International Patent Application No. PCT/KR2017/015675.
(Continued)

*Primary Examiner* — Tony O Davis
(74) *Attorney, Agent, or Firm* — Staas & Halsey LLP

(57) ABSTRACT

A display apparatus is provided. The display apparatus includes: a display panel; a sensor configured to sense illuminance around the display panel; a communicator configured to perform communication with an external apparatus; and a processor configured to allow a test image having luminance determined on the basis of the sensed illuminance to be displayed on the display panel, receive correction data from the external apparatus photographing the displayed test image through the communicator, and correct luminance of the display panel on the basis of the correction data, wherein the test image is a single color image including a plurality of markers, and the processor allows the test image to be displayed at luminance that becomes relatively high as a level of the sensed illuminance becomes high.

16 Claims, 10 Drawing Sheets

(51) Int. Cl.
*G09G 3/34* (2006.01)
*G09G 3/00* (2006.01)

(52) U.S. Cl.
CPC ..... *G09G 3/2081* (2013.01); *G09G 3/3413* (2013.01); *G09G 3/3648* (2013.01); *G09G 2320/029* (2013.01); *G09G 2320/0233* (2013.01); *G09G 2320/0285* (2013.01); *G09G 2320/0693* (2013.01); *G09G 2360/144* (2013.01); *G09G 2360/145* (2013.01)

(58) Field of Classification Search
CPC .. G09G 2360/145; G09G 3/20; G09G 3/2081; G09G 3/3413; G09G 3/3607
USPC ..... 345/87, 168, 207
See application file for complete search history.

(56) References Cited

U.S. PATENT DOCUMENTS

| | | | | |
|---|---|---|---|---|
| 2013/0120330 | A1* | 5/2013 | Kang | G09G 5/10 345/207 |
| 2014/0132158 | A1 | 5/2014 | Land et al. | |
| 2015/0178949 | A1 | 6/2015 | Ren et al. | |
| 2015/0287350 | A1 | 10/2015 | Jun et al. | |
| 2015/0317944 | A1 | 11/2015 | Safaee-Rad et al. | |
| 2016/0050402 | A1 | 2/2016 | Jeong et al. | |
| 2018/0190214 | A1* | 7/2018 | Kim | G09G 3/20 |

FOREIGN PATENT DOCUMENTS

| | | |
|---|---|---|
| JP | 2013-62625 | 4/2013 |
| KR | 10-1341584 | 2/2014 |
| KR | 10-2014-0140941 | 12/2014 |
| KR | 10-1509247 | 3/2015 |
| KR | 10-2015-0098941 | 8/2015 |
| KR | 10-2016-0015789 | 2/2016 |
| KR | 10-2016-0021966 | 2/2016 |
| KR | 10-2016-0079246 | 7/2016 |
| KR | 10-1651620 | 8/2016 |

OTHER PUBLICATIONS

Written Opinion, PCT/ISA/237, dated Apr. 17, 2018, in corresponding International Patent Application No. PCT/KR2017/015675.
Extended European Search Report dated Jul. 31, 2019 in European Patent Application No. 17889177.6.

* cited by examiner

DISPLAY APPARATUS AND DISPLAY METHOD

CROSS-REFERENCE TO RELATED APPLICATIONS

This application claims priority from Korean Patent Application No. 10-2016-0183759, filed on Dec. 30, 2016, in the Korean Intellectual Property Office, the disclosure of which is incorporated herein by reference in its entirety.

BACKGROUND OF THE INVENTION

Field of the Invention

Apparatuses and methods consistent with the present disclosure relate to a display apparatus and a display method, and more particularly, to a display apparatus and a display method capable of correcting regions having non-uniform luminance.

Description of the Related Art

A display apparatus is an apparatus displaying an image signal provided from an external apparatus. Recently, a function capable of providing various user experiences as well as a general function of displaying an image has been added to the display apparatus.

In this case, generally, the display apparatus includes a liquid crystal display (LCD) panel to display the image signal.

However, the LCD panel may not have the entirely uniform image quality due to a pressure applied to a liquid crystal, a luminance difference between light sources supplied to light to the LCD panel, and the like.

SUMMARY OF THE INVENTION

Exemplary embodiments of the present disclosure overcome the above disadvantages and other disadvantages not described above. Also, the present disclosure is not required to overcome the disadvantages described above, and an exemplary embodiment of the present disclosure may not overcome any of the problems described above.

The present disclosure provides a display apparatus and a display method in which panel distortion of the display apparatus may be corrected using a terminal apparatus including a camera.

According to an aspect of the present disclosure, a display apparatus includes: a display panel; a sensor configured to sense illuminance around the display panel; a communicator configured to perform communication with an external apparatus; and a processor configured to allow a test image having luminance determined on the basis of the sensed illuminance to be displayed on the display panel, receive correction data from the external apparatus photographing the displayed test image through the communicator, and correct luminance of the display panel on the basis of the correction data, wherein the test image is a single color image including a plurality of markers, and the processor allows the test image to be displayed at luminance that becomes relatively high as a level of the sensed illuminance becomes high.

The correction data may include data on a correction gray scale value of a specific region of the display panel.

The external apparatus may divide the photographed test image into a plurality of regions, measure luminance of each of the plurality of regions, calculate a correction gray scale value required for the luminance measured in each region to be target luminance, and transmit data on the correction gray scale value to the display apparatus.

The display apparatus may further include a timing controller configured to drive the display panel, wherein the processor controls the timing controller so that a gray scale value of image data displayed on the specific region of the display panel is corrected on the basis of the correction gray scale value.

The processor may correct a gray scale value of image data displayed on the specific region of the display panel on the basis of the correction gray scale value, and display the image data of which the gray scale value is corrected on the specific region.

The processor may correct luminance of the specific region of the display panel by controlling a light source of a backlight irradiating light to the specific region of the display panel on the basis of the correction gray scale value.

The plurality of markers may be displayed on corner portions of the test image.

According to another aspect of the present disclosure, a display method of a display apparatus including a display panel includes: sensing illuminance around the display panel; displaying a test image having luminance determined on the basis of the sensed illuminance; receiving correction data from an external apparatus photographing the displayed test image; and correcting luminance of the display panel on the basis of the correction data, wherein the test image is a single color image including a plurality of markers, and in the displaying, the test image is displayed at luminance that becomes relatively high as a level of the sensed illuminance becomes high.

The correction data may include data on a correction gray scale value of a specific region of the display panel.

The external apparatus may divide the photographed test image into a plurality of regions, measure luminance of each of the plurality of regions, calculate a correction gray scale value required for the luminance measured in each region to be target luminance, and transmit data on the correction gray scale value to the display apparatus.

In the displaying, a timing controller of the display apparatus may be controlled so that a gray scale value of image data displayed on the specific region of the display panel is corrected on the basis of the correction gray scale value.

In the displaying, a gray scale value of image data displayed on the specific region of the display panel may be corrected on the basis of the correction gray scale value, and the image data of which the gray scale value is corrected may be displayed on the specific region.

In the displaying, luminance of the specific region of the display panel may be corrected by controlling a light source of a backlight irradiating light to the specific region of the display panel on the basis of the correction gray scale value.

The plurality of markers may be displayed on corner portions of the test image.

As set forth above, according to the diverse exemplary embodiments of the present disclosure, regions having non-uniform luminance in the display apparatus may be corrected to display an image having good image quality.

BRIEF DESCRIPTION OF THE DRAWING FIGURES

The above and/or other aspects of the present disclosure will be more apparent by describing certain exemplary embodiments of the present disclosure with reference to the accompanying drawings, in which.

DETAILED DESCRIPTION OF THE EXEMPLARY EMBODIMENTS

Figure 1:
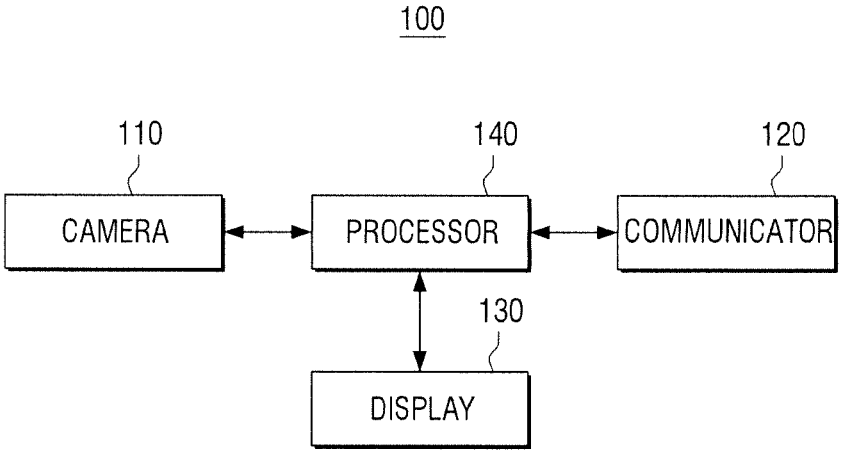
FIG. 1 is a block diagram for describing components of a terminal apparatus according to an exemplary embodiment of the present disclosure.

Since the present disclosure may be variously modified and have several exemplary embodiments, specific exemplary embodiments of the present disclosure will be illustrated in the drawings and be described in detail in the detailed description. However, it is to be understood that the present disclosure is not limited to specific exemplary embodiments, but includes all modifications, equivalents, and substitutions without departing from the scope and spirit of the present disclosure. When it is decided that a detailed description for the known art related to the present disclosure may obscure the gist of the present disclosure, the detailed description will be omitted.

Terms 'first', 'second', and the like, may be used to describe various components, but the components are not to be construed as being limited by the terms. The terms are used only to distinguish one component from another component.

Terms used in the present disclosure are used only to describe specific exemplary embodiments rather than limiting the scope of the present disclosure. Singular forms are intended to include plural forms unless the context clearly indicates otherwise. It will be further understood that terms "include" or "formed of" used in the present specification specify the presence of features, numerals, steps, operations, components, parts, or combinations thereof mentioned in the present specification, but do not preclude the presence or addition of one or more other features, numerals, steps, operations, components, parts, or combinations thereof.

In exemplary embodiments, a 'module' or an '~er/or' may perform at least one function or operation, and be implemented by hardware or software or be implemented by a combination of hardware and software. In addition, a plurality of 'modules' or a plurality of '~ers/ors' may be integrated in at least one module and be implemented by at least one processor (not illustrated) except for a 'module' or an '~er/or' that needs to be implemented by specific hardware.

Hereinafter, the present disclosure will be described in detail with reference to the accompanying drawings.

FIG. 1 is a block diagram for describing components of a terminal apparatus according to an exemplary embodiment of the present disclosure.

Referring to FIG. 1, a terminal apparatus 100 includes a camera 110, a communicator 120, a display 130, and a processor 140.

In FIG. 1, the terminal apparatus 100 may be implemented by a smartphone. However, this is only an example, and the terminal apparatus 100 may be implemented by various types of electronic apparatuses that may be carried by users, such as a tablet personal computer (PC), a mobile phone, a personal digital assistant (PDA), a portable multimedia player (PMP), a wearable device, and the like.

The camera 110 photographs an image. In detail, the camera 110 may photograph a test image displayed on a display apparatus 200 (see FIG. 6).

To this end, the camera 110 may include an image sensor (not illustrated), lenses (not illustrated), and the like, and process an image frame such as an image, or the like, obtained by the image sensor.

The communicator 120 performs communication with the display apparatus 200. In addition, the communicator 120 may transmit and receive various data to and from the display apparatus 200.

In this case, the communicator 120 may perform the communication with the display apparatus 200 in various types of communication manners. For example, the communicator 120 may perform the communication with the display apparatus 200 depending on a communication standard such as Bluetooth, Wi-Fi, or the like, using a near field communication module.

The display 130 displays the image. In this case, the display 130 may be implemented by various types of displays such as a liquid crystal display (LCD), and the like. Meanwhile, the display 130 may be implemented by a touch screen by combining with a touch panel.

The processor 140 controls a general operation of the terminal apparatus 100. For example, the processor 140 may drive an operating system or an application program to control hardware or software components connected to the processor 140, and perform various kinds of data processing and calculation. In addition, the processor 140 may load and process commands or data received from at least one of other components in a volatile memory, and store various data in a non-volatile memory.

To this end, the processor 140 may be implemented by a dedicated processor (for example, an embedded processor) for performing a corresponding operation or a generic-purpose processor (for example, a central processing unit (CPU) or an application processor) capable of performing corresponding operations by executing one or more software programs stored in a memory device.

First, when a user input for executing an application related to luminance correction is received, the processor 140 may drive the camera, and display the image photographed by the camera on the display 130. That is, the processor 140 may display a live view image on the display 130. In this case, the application may be downloaded through a server (not illustrated), or the like, and be installed in the terminal apparatus 100.

Here, the photographed image may be the test image displayed on the display apparatus 200. In this case, the test image may be a single color image including a plurality of markers.

In this case, the processor 140 may overlap and display a plurality of guides with the photographed test image.

Here, the guides may be graphic user interfaces (GUIs) for guiding the user to photograph the test image from the front of the display apparatus 200 without inclining a photographing direction of the camera 110 when the user photographs the test image displayed on the display apparatus 200.

Figure 2:
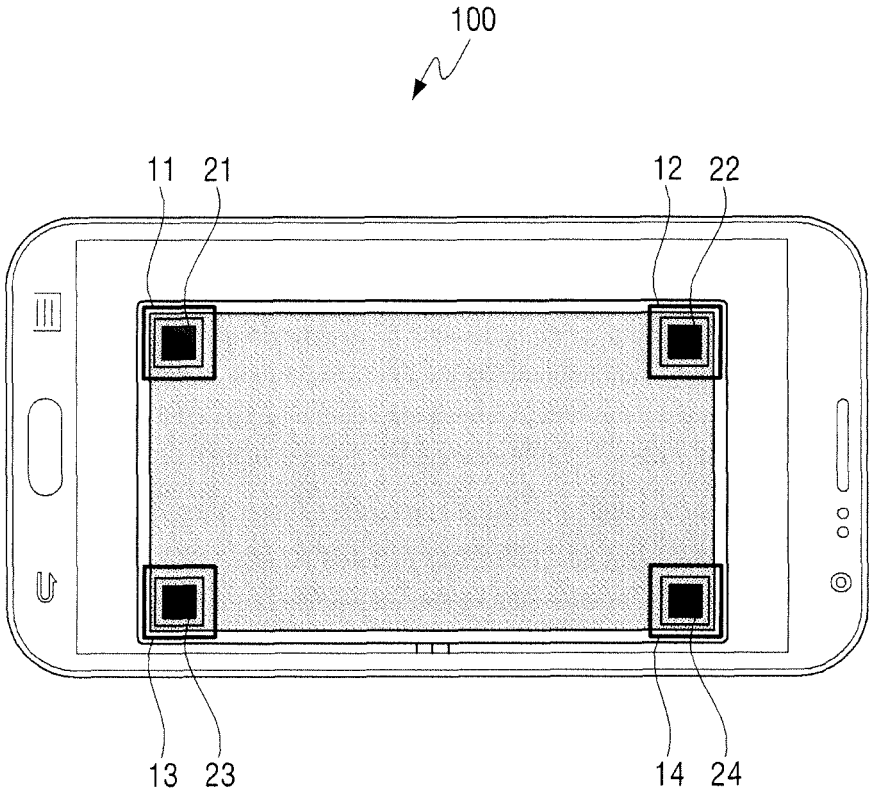
FIGS. 2 to 4 are views for describing a method of photographing a test image according to an exemplary embodiment of the present disclosure.

As an example, as illustrated in FIG. 2, guides 11, 12, 13, and 14 have a rectangular shape, and guides of which the number is the same as that of markers 21, 22, 23, and 24 displayed on the display apparatus 200 may be overlapped and displayed with the photographed test image.

Therefore, the user may perform photographing so that the markers displayed on the display apparatus 200 enter the guides, to allow the photographing direction of the camera 110 not to be inclined, if possible, resulting in allowing the photographed test image not to be inclined.

Meanwhile, although a case in which the guides have the rectangular shape is described in the abovementioned example, this is only an example, and the guides may have various shapes such as a circular shape, a polygonal shape, and the like. In addition, although a case in which guides of which the number is the same as that of markers are displayed is described, this is only an example, and only at least one guide may also be displayed.

Meanwhile, when a user input for capturing the photographed test image is received, the processor 140 may control the camera 110 to capture the photographed test image and store the captured test image (that is, an image frame). However, in the case in which the markers are positioned in the guides in the photographed test image, the processor 140 may automatically capture and store the photographed test image even though a separate user input is not received.

In this case, the processor 140 may also filter the photographed image through a Gaussian filter, or the like, to remove a moiré at the time of photographing the image.

As described above, the processor 140 may obtain the test image displayed on the display apparatus 200.

Meanwhile, even though the photographing is performed so that the markers enter the guides, in the case in which the photographing is not performed from the front of the display apparatus, but is performed in a state in which the camera 110 is slightly inclined in upward and downward and leftward and rightward directions, the photographed test image (that is, the captured image) may be in an inclined state.

In this case, the processor 140 may detect the plurality of markers from the photographed test image and extend or contract the photographed test image depending on a predetermined ratio using the plurality of markers to map the photographed test image to a rectangular image having a predefined size.

For example, a case in which the processor 140 maps the photographed test image to an image having a size of j*k is assumed. In this case, based on a left upper end corner of the image having the size of j*k, a coordinate value of the left upper end corner may be (0,0), a coordinate value of a right upper end corner may be (j,0), a coordinate value of a left lower end corner may be (0,k), and a coordinate value of a right lower end corner may be (j,k).

In this case, as described above, the respective markers in the test image are displayed on the respective corner portions of the test image. In this case, the processor may calculate coordinate values of specific points (for example, corner portions of the markers or central portions of the markers) of the respective markers in a photographed image frame, map the coordinate values of the corresponding points to (0,0), (j,0), (0,k), and (j,k), and adaptively map the remaining pixels of the photographed test image depending on a ratio to convert the test image included in the photographed image frame into a rectangular image having a predefined size. In this case, a predefined image has a size corresponding to that of the test image displayed on the display apparatus 200, and information on the predefined image may be pre-stored in the terminal apparatus 100.

As described above, the markers are displayed on the corner portions of the test image. Therefore, even in the case in which the test image is photographed in the inclined state, the terminal apparatus 100 may convert the test image photographed in the inclined state into the rectangular image appropriate for a display panel of the display apparatus 200 using the markers.

Meanwhile, the processor 140 may detect regions (for example, mura regions) having non-uniform luminance in the display apparatus 200 on the basis of the photographed test image, and generate correction data for correcting luminance of the detected regions. Here, the mura regions means regions having luminance relatively higher or lower than that of the surrounding regions in the test image displayed on the display apparatus 200.

To this end, the processor 140 may divide the photographed test image into a plurality of regions (or a plurality of blocks), and measure luminance values of each of the plurality of regions.

Figure 3:
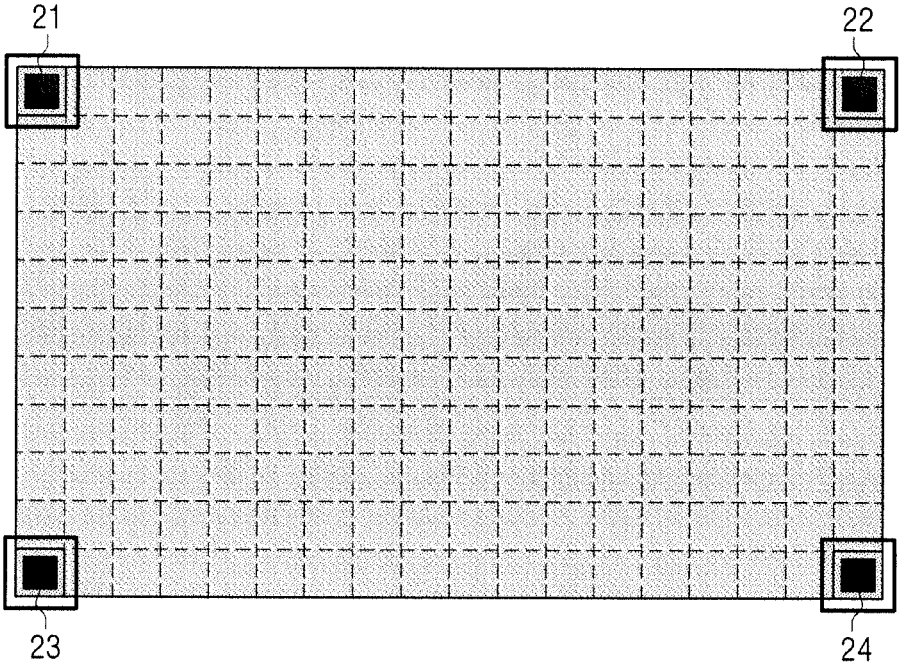

For example, as illustrated in FIG. 3, the processor 140 may divide the photographed test image in a horizontal direction and a vertical direction to divide photographed test image into a plurality of regions having a matrix form.

In this case, as illustrated in FIG. 3, markers 21, 22, 23, and 24 may exist in some of the regions in the photographed test image in that the plurality of markers are included in the test image displayed by the display apparatus 200.

Figure 4:
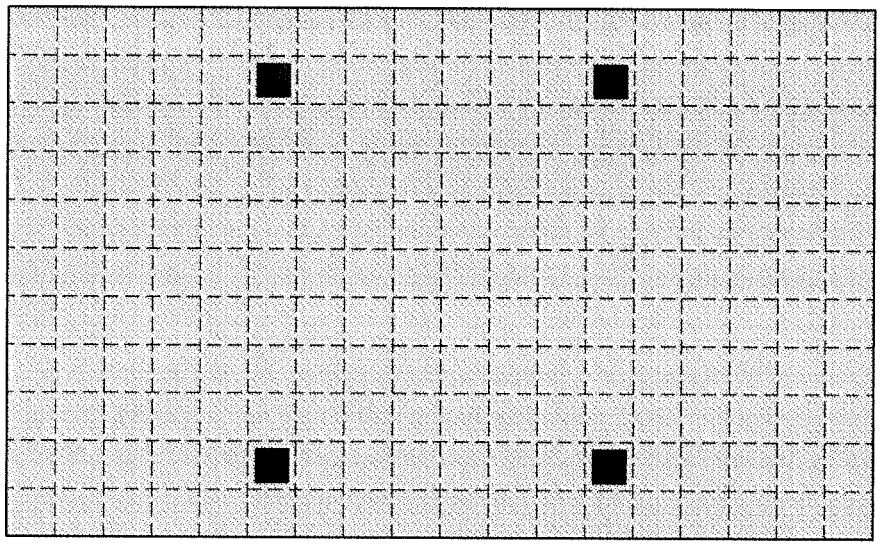

Therefore, the display apparatus 200 may change positions of the markers, as illustrated in FIG. 4, in that some of the regions of the test image are hidden by the markers, and the processor 140 may photograph a test image in which the positions of the markers are changed through the camera 110 to obtain a test image displayed in regions in which the markers are initially positioned.

Meanwhile, data obtained by the photographing through the camera 110 may include red (R), green (G), and blue (B) gray scale values (that is, gray levels, which are mainly 8 bits, and in this case, data may be represented by 256 gray scales) of each of a plurality of pixels of the test image.

In this case, the processor 140 may calculate luminance for each of the plurality of regions of the photographed test image using the R, G, and B gray scale values.

For example, the processor 140 may calculate an average of R gray scale values, an average of G gray scale values, and an average of B gray scale values of pixels included in the respective regions, and calculate luminance of the respective regions using the calculated R, G, and B average gray scale values.

In addition, the processor 140 may decide correction gray scale values required for the luminance calculated for the respective regions to be target luminance.

Here, the target luminance may be variously determined.

For example, the target luminance may be one of luminance values of adjacent regions.

Figure 5:
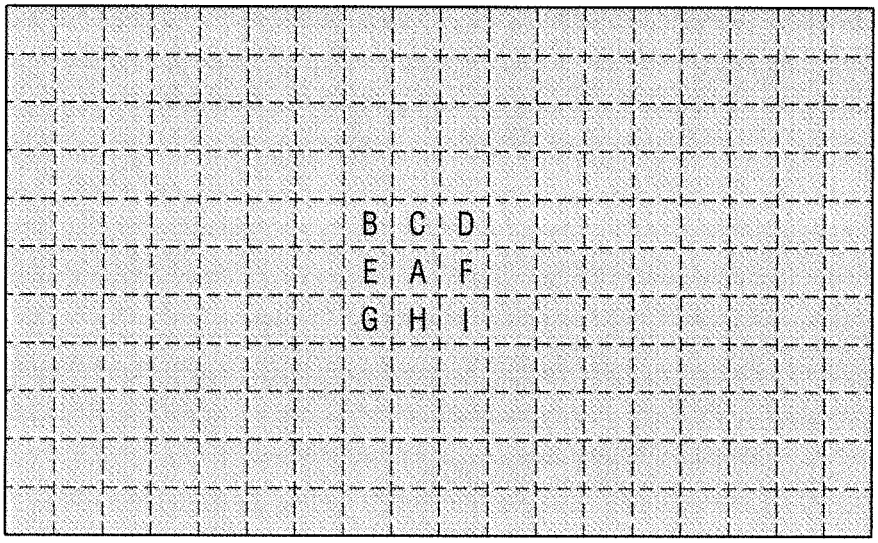
FIG. 5 is a view for describing a method for calculating correction gray scale values according to an exemplary embodiment of the present disclosure.

For example, a case of deciding correction gray scale values for region A is assumed in FIG. 5.

In this case, the processor 140 may select one of regions B, C, D, E, F, G, H, and I, which are regions adjacent to region A, and calculate correction gray scale values required to correct R, G, and B average gray scale values of region A by R, G, and B average gray scale values of the selected region.

For example, a case in which the selected region is region B and R, G, and B average gray scale values of region B are ($r_1$, $g_1$, $b_1$) is assumed.

In this case, the processor 140 may calculate correction gray scale values for region A as ($r_c$, $g_c$, $b_c$) in the case in which the R, G, and B average gray scale values of region A are ($r_2$, $g_2$, $b_2$). Here, $r_c=r_1-r_2$, $g_c=g_1-g_2$, and $b_c=b_1-b_2$.

As described above, the processor 140 may calculate correction gray scale values for the respective regions through the method described above.

Meanwhile, although a case in which the processor selects any region of regions adjacent to a specific region and calculates correction gray scale values for the specific region is described in the abovementioned example, this is only an example.

That is, the processor 140 may calculate the correction gray scale values for the specific region by calculating a difference between average gray scale values of the specific region and average gray scale values of a region having the smallest luminance among the regions adjacent to the specific region. Alternatively, the processor 140 may calculate the correction gray scale values for the specific region by deciding a region having the smallest luminance among all the regions rather than only the regions adjacent to the specific region and calculating a difference between average gray scale values of the specific region and average gray scale values of the region having the smallest luminance among all the regions.

The reason why a region having low luminance is used as a reference region as described above is that it is relatively easier to decrease luminance than to increase luminance.

However, this is only an example, and the processor 140 may calculate the correction gray scale values for the specific region by calculating a difference between average gray scale values of the specific region and average gray scale values of a region having the largest luminance among the regions adjacent to the specific region. Alternatively, the processor 140 may calculate the correction gray scale values for the specific region by calculating a difference between average gray scale values of the specific region and average gray scale values of a region having the largest luminance among all the regions.

Then, the processor 140 may transmit data on the correction gray scale values to the display apparatus 200 through the communicator 120.

In detail, the processor 140 may transmit the correction gray scale values calculated for the respective regions to the display apparatus 200.

In this case, the processor 140 may also transmit data indicating into how many regions the photographed test image is divided (for example, into how many regions the photographed test image is divided in each of the horizontal direction and the vertical direction), data indicating a position of a region in which each correction gray scale value is calculated for each of the correction gray scale values (for example, data indicating in which row and which column the region is positioned), and the like, to the display apparatus 200.

Figure 6:
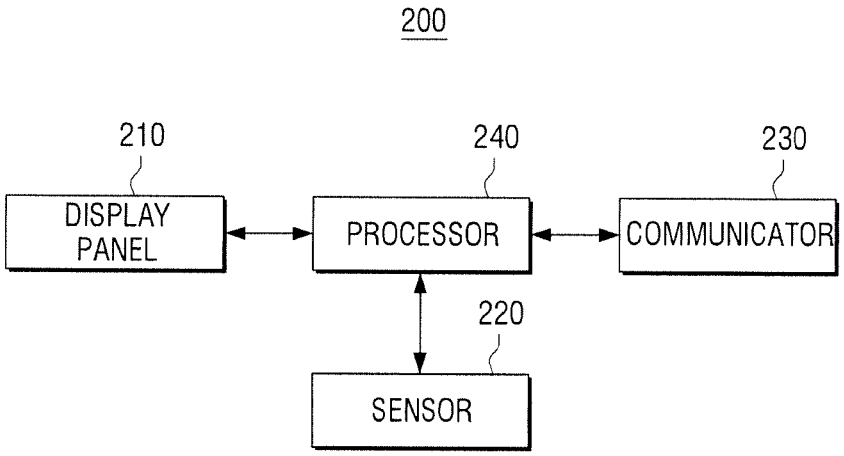
FIGS. 6 to 8 are block diagrams for describing components of a display apparatus according to an exemplary embodiment of the present disclosure.

FIG. 6 is a block diagram for describing components of a display apparatus according to an exemplary embodiment of the present disclosure. In FIG. 6, a display apparatus 200 may be implemented by a television (TV).

Referring to FIG. 6, the display apparatus 200 includes a display panel 210, a sensor 220, a communicator 230, and a processor 240.

The display panel 210 displays an image. For example, the display panel 210 may be implemented by various types of display panels such as an LCD, and the like.

Figure 7:
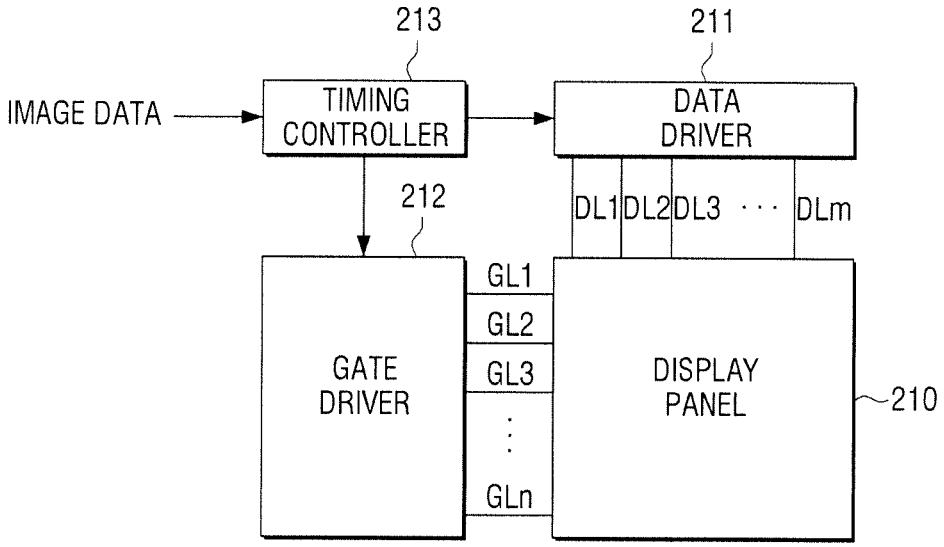

As an example, in the case in which the display panel 210 is implemented by the LCD panel, the display panel 210 may include a plurality of pixels connected to a plurality of data lines DL1, DL2, DL3, . . . , DLm and a plurality of gate lines GL1, GL2, GL3, . . . , GLn and disposed in a matrix form, as illustrated in FIG. 7. In this case, the display apparatus 200 may further include a data driver 211 supplying data voltages to the plurality of data lines to drive the plurality of data lines, a gate driver 212 supplying scan signals to the plurality of gate lines to drive the plurality of gate lines, and a timing controller (TCON) 213 driving the display panel 210.

In this case, although not illustrated in FIG. 7, a backlight (or a backlight unit) (not illustrated) supplying light to the display panel 210 may be further included in the display apparatus 200.

However, this is only an example, and the display panel 210 may be a light emitting diode (LED) panel or an organic light emitting diode (OLED) panel including a self light emitting element such an LED, an OLED, or the like.

The sensor 220 senses illuminance around the display panel 210. In this case, the sensor 220 may include one sensor disposed at a specific position on the display apparatus 200 or include a plurality of sensors disposed at positions spaced apart from each other on the display apparatus 200.

In this case, the sensor may be an illuminance sensor sensing illuminance or a color sensor that may sense a color temperature as well as illuminance.

Meanwhile, in the case in which the sensor 220 includes two sensors, the sensor 220 may include one illuminance sensor and one color sensor or include two color sensors. Meanwhile, both of the two sensors may be implemented by illuminance sensors, but it is preferable that at least one color sensor is included.

The communicator 230 performs communication with an external apparatus. In addition, the communicator 230 may transmit and receive various data to and from the external apparatus. Here, the external apparatus may be the terminal apparatus 100.

In this case, the communicator 230 may perform the communication with the terminal apparatus 100 in various types of communication manners. For example, the communicator 230 may perform the communication with the terminal apparatus 100 depending on a communication standard such as Bluetooth, Wi-Fi, or the like, using a near field communication module.

The processor 240 controls a general operation of the display apparatus 200. For example, the processor 240 may drive an operating system or an application program to control hardware or software components connected to the processor 240, and perform various kinds of data processing and calculation. In addition, the processor 240 may load and process commands or data received from at least one of other components in a volatile memory, and store various data in a non-volatile memory.

To this end, the processor 240 may be implemented by a dedicated processor (for example, an embedded processor) for performing a corresponding operation or a generic-purpose processor (for example, a CPU or an application processor) capable of performing corresponding operations by executing one or more software programs stored in a memory device.

First, the processor 240 may display a test image on the display panel 210. In this case, when a user command for luminance correction is input, the processor 240 may display the test image on the display panel 210.

Here, the test image may be a single color image including a plurality of markers.

Here, a single color may be a gray color or a black color. However, this is only an example, and the test image may be a multi-color image.

In addition, the markers may be displayed on corner portions of the test image. In addition, the markers may be overlapped with the respective corner portions of the test image. For example, the markers may be displayed on a left upper end corner, a right upper end corner, a left lower end corner, and a right lower end corner of the test image.

In this case, when a predetermined time elapses after the test image including the plurality of markers is displayed, the processor 240 may change positions of the plurality of markers. In this case, positions at which the markers are displayed may be randomly determined.

For example, when a predetermined time elapses after the test image as illustrated in FIG. 3 is displayed on the display panel 210, the processor 240 may display the test image as illustrated in FIG. 4 on the display panel 210.

Meanwhile, the processor 240 may allow a test image having luminance determined on the basis of the sensed illuminance to be displayed on the display panel 210.

That is, the processor 240 may determine the luminance of the displayed test image depending on a level of the sensed illuminance, and display the test image having the determined luminance on the display panel 210.

In detail, the processor 240 may allow the test image to be displayed at luminance that becomes relatively high as the level of the sensed illuminance becomes high. In addition, the processor 240 may allow the test image to be displayed at luminance that becomes relatively low as the level of the sensed illuminance becomes low.

As described above, the processor 240 may determine the luminance of the test image to be in proportion to the level of the sensed illuminance.

To this end, information on luminance of the test image depending on an illuminance level may be pre-stored in the display apparatus 200. Alternatively, information on luminance of the test image corresponding to a predetermined reference illuminance level and a luminance change amount of the test image depending on an illuminance change may be pre-stored.

Therefore, the processor 240 may determine luminance of the test image depending on the sensed illuminance on the basis of the pre-stored information, and allow the test image having the determined luminance to be displayed on the display panel 210.

For example, a case in which when an illuminance level is luminance stored to be matched to the illuminance level of $i_1$ is $l_1$ and when an illuminance level is $i_2$, luminance stored to be matched to the illuminance level of $i_2$ is $l_2$ is assumed. In this case, when $i_1<i_2$, $l_1<l_2$.

In this case, when the illuminance level sensed through the sensor 220 is $i_1$, the processor 240 may display the test image at luminance of on the display panel 210. In addition, when the illuminance level sensed through the sensor 220 is $i_2$, the processor 240 may display the test image at luminance of $l_2$ on the display panel 210.

Meanwhile, the processor 240 may display a test image having specific luminance through various methods.

For example, the processor 240 may adjust brightness of the backlight (not illustrated) supplying the light to the display panel 210 to provide the test image having the specific luminance. To this end, a dimming signal corresponding to the determined luminance may be used. Here, the dimming signal may be a pulse width modulation (PWM) signal having a duty corresponding to a dimming value.

In this case, the timing controller 213 may generate the dimming signal on the basis of the dimming value input from the processor 240, and provide the generated dimming signal to the backlight (not illustrated). Therefore, a supply time, strength, and the like, of a driving current supplied to the backlight (not illustrated) are adjusted, such that luminance of light sources of the backlight (not illustrated) may be controlled.

Meanwhile, although a case in which the timing controller 213 receives the dimming value from the processor 240 and generates the dimming signal corresponding to the dimming value is described hereinabove, the timing controller 213 may also directly generate the dimming value, and generate the dimming signal by the generated dimming value.

As another example, the processor 240 may change a gray scale value of a pre-stored test image itself to provide the test image corresponding to the determined luminance, or may generate and provide the test image corresponding to the determined luminance. For example, in the case in which the processor 240 provides a gray test image, the processor 240 may generate and provide the test image corresponding to the determined luminance in a gray scale range representing a gray color.

Meanwhile, a manner as in the example described above is an example of a case in which the display panel 210 is implemented by the LCD panel.

However, in the case in which the display panel 210 is implanted by a self light emitting panel including a self light emitting element such an LED, an OLED, or the like, the processor 240 may change a gray scale value of a pre-stored test image itself to provide the test image corresponding to the determined luminance, or may generate and provide the test image corresponding to the determined luminance.

As described above, the display apparatus 200 determines the luminance of the test image depending on the sensed illuminance to minimize an influence of the surrounding light sources of the display panel 210 when the terminal apparatus 100 photographs the test image displayed on the display apparatus 200 to decide regions having non-uniform luminance in the display apparatus 200. That is, the display apparatus 200 determines the luminance of the test image depending on the sensed illuminance to allow the regions having the non-uniform luminance in the photographed test image to be clearly distinguished by displaying a test image having high luminance when the illuminance around the display panel is high.

Meanwhile, the processor 240 may receive correction data from the external apparatus 100 photographing the test image displayed on the display panel 210, through the communicator 230.

In this case, the processor 240 may store the correction data received from the external apparatus 100 through the communicator 230 in a storing medium of the display apparatus 200.

As an example, the processor 240 may store the correction data in a memory (not illustrated) (for example, a flash memory) provided in the display panel 210.

Generally, a manufacturer stores correction data (for example, demura data) for removing a mura effect occurring at the time of manufacturing a display panel in a flash memory (not illustrated).

However, the correction data are data in which only factors occurring at the time of manufacturing the display panel are considered, and are not data in which distortion of the display panel that may occur due to mechanical deformation, or the like, in distribution and installation processes of products is also considered.

Therefore, in the present disclosure, after the display apparatus 200 is installed at a fixed position through a distribution process, the display apparatus 200 receives the correction data generated by the external apparatus 100 from the external apparatus 100 and stores the correction data, and then uses the stored correction data when the display apparatus 200 displays an image.

Meanwhile, the correction data received from the external apparatus 100 may include data on correction gray scale values of a specific region of the display panel 210. Meanwhile, the correction gray scale values are described above with reference to FIG. 1.

In this case, the processor 240 may correct luminance of the display panel 210 on the basis of the correction data.

In detail, the processor 240 may control driving of the display panel 210 on the basis of the correction data or adjust gray scale values of the image displayed on the display panel 210 to correct the luminance of the display panel 210.

Here, the image may be a still image or a moving image.

First, the processor 240 may divide the display panel 210 into a plurality of regions by the same method as the method of dividing the photographed image into the plurality of regions in the external apparatus 100 on the basis of data received from the external apparatus 100.

In addition, the processor 240 may decide regions to which the correction gray scale values are applied among the plurality of regions of the display panel 210 on the basis of the data received from the external apparatus 100, and correct the luminance of the display panel 210 using the correction gray scale values corresponding to the corresponding regions for each of the decided regions.

Here, the data received from the terminal apparatus 100 may include data indicating into how many regions the photographed test image is divided, data indicating a position of a region in which each correction gray scale value is calculated for each of the correction gray scale values, and the like.

In this case, the processor 240 may correct the luminance of the display panel 210 by various methods.

As an exemplary embodiment, the processor 240 may control the timing controller 213 driving the display panel 210 to correct the luminance of the display panel 210.

In detail, the processor 240 may control the timing controller 213 so that gray scale values of image data displayed on the specific region of the display panel 210 are corrected on the basis of the correction gray scale values.

The timing controller 213 may receive timing signals such as vertical synchronization signals, horizontal synchronization signals, input data enable signals, clock signals, and the like, generate various control signals, and output the control signals to the data driver 211 and the gate driver 212, to control the data driver 211 and the gate driver 212.

In addition, the timing controller 213 converts the input image data to be appropriate for a data signal format used in the data driver 211, outputs the converted image data to the data driver 211, and controls data driving in an appropriate time depending on a scan.

In addition, the gate driver 212 sequentially supplies scan signals having an on-voltage or off-voltage to the plurality of gate lines to sequentially drive the plurality of gate lines, depending on a control of the timing controller 213.

In addition, the data driver 211 stores the image data input from the timing controller 213, and converts the image data into data voltages having an analog form and supplies the data voltages to the plurality of data lines to drive the plurality of data lines, when a specific gate line is opened, depending on a control of the timing controller 213.

In this case, the processor 240 may control the timing controller 213 to add and output correction gray scale values calculated in the specific region to R, G, and B gray scale values of image data that are to be displayed on the specific region.

For example, in the case in which the R, G, and B gray scale values of image data that are to be displayed on the specific region of the display panel 210 are ($r_A$, $g_A$, $b_A$) and the correction gray scale values of the specific region are ($r_C$, $g_C$, $b_C$), the timing controller 213 may receive the R, G, and B gray scale values ($r_A$, $g_A$, $b_A$) of the image data, obtain the correction gray scale values ($r_C$, $g_C$, $b_C$) from the memory (not illustrated) provided in the display panel 210, and output the corrected gray scale values ($r_A+r_C$, $g_A+g_C$, $b_A+b_C$) to the data driver 211.

Therefore, the data driver 211 may display an image having the gray scale values of ($r_A+r_C$, $g_A+g_C$, $b_A+b_C$) in the specific region of the display panel 210.

Such a manner may be applied to a case in which the image displayed on the display panel 210 is a still image or a moving image.

According to another exemplary embodiment, the processor 240 may correct gray scale values of an image displayed on the specific region of the display panel 210 on the basis of the correction gray scale values, and display image data of which the gray scale values are corrected on the display panel 210.

In detail, the processor 240 may correct the gray scale values of the image data through image processing for the input image data, and provide corrected image data to the timing controller 213. That is, the processor 240 may add up the correction gray scale values corresponding to the R, G, and B gray scale values of the input image data to generate the corrected image data.

For example, in the case in which the R, G, and B gray scale values of image data that are to be displayed on the specific region of the display panel 210 are ($r_A$, $g_A$, $b_A$) and the correction gray scale values of the specific region are ($r_C$, $g_C$, $b_C$), the processor 240 may receive the R, G, and B gray scale values ($r_A$, $g_A$, $b_A$) of the image data, obtain the correction gray scale values ($r_C$, $g_C$, $b_C$) from the memory (not illustrated) to generate image data having the corrected image gray scale values ($r_A+r_C$, $g_A+g_C$, $b_A+b_C$), and provide the image data to the timing controller 213. In this case, the timing controller 214 may output data voltages corresponding to the gray scale values of the input image data to the data driver 211.

Therefore, the data driver 211 may display the image having the gray scale values of ($r_A+r_C$, $g_A+g_C$, $b_A+b_C$) in the specific region of the display panel 210.

Such a manner may be applied to a case in which the image displayed on the display panel 210 is a still image.

Meanwhile, a case in which the luminance is corrected by adjusting the gray scale values of the image or is corrected by controlling the timing controller 213 is described in the abovementioned example. However, according to an exemplary embodiment of the present disclosure, the luminance may also be corrected by controlling the backlight (not illustrated).

In detail, the backlight (not illustrated), which is a point source including a plurality of light sources, may support local dimming.

Here, the light sources configuring the backlight (not illustrated) may be formed of cold cathode fluorescent lamps (CCFLs) or light emitting diodes (LEDs). Although a case in which the backlight includes LEDs and an LED driving circuit is illustrated and described hereinafter, the backlight may also be implemented by components other than the LEDs at the time of being implemented. In addition, the plurality of light sources configuring the backlight (not illustrated) may be disposed in various forms, and various local dimming techniques may be applied. For example, the backlight (not illustrated) may be a direct type backlight in which a plurality of light sources are disposed in a matrix form and are uniformly disposed over an entire liquid crystal screen. In this case, the backlight may be operated in a full-array local dimming manner or a direct local dimming manner. Here, the full-array local dimming manner is a dimming manner in which the light sources are entirely uniformly disposed behind an LCD screen and luminance adjustment is performed for each light source. In addition, the direct local dimming manner is a dimming manner which is similar to the full-array local dimming manner, but in which luminance adjustment is performed for each light source by a smaller number of light sources.

In addition, the backlight may be an edge type backlight. In this case, the backlight may be operated in an edge-lit local dimming manner. In the edge-lit local dimming manner, a plurality of light sources may be disposed at only edges of the panel, be disposed at only the left and right of the panel, be disposed at only upper and lower portions of the panel, or be disposed at the left and right and upper and lower portions of the panel.

Luminance of the specific region may be controlled by adjusting brightness of the light source irradiating light to the specific region through the local dimming as described above.

That is, the processor 240 may correct the luminance of the specific region of the display panel 210 by controlling the light sources of the backlight (not illustrated) emitting the light to the specific region of the display panel 210 on the basis of the correction gray scale values.

To this end, information on brightness of the light sources adjusted depending on the correction gray scale values may be pre-stored in the display apparatus 200. Alternatively, information on brightness of the light sources corresponding to predetermined reference correction gray scale values and change amounts of the brightness of the light sources depending on a change in the reference correction gray scale values may be pre-stored.

For example, the processor 240 may perform local dimming on regions that need to be displayed to be brighter as compared with before the correction gray scale values are applied so that light sources corresponding to the corresponding regions have high luminance depending on the correction gray scale values, and perform local dimming on regions that need to be displayed to be darker as compared with before the correction gray scale values are applied so that light sources corresponding to the corresponding regions have low luminance depending on the correction gray scale values.

Therefore, the processor 240 may correct luminance for each of the regions by adjusting luminance of the light sources corresponding to the specific region for each of the correction gray scale values on the basis of the pre-stored information.

Meanwhile, although a case in which the display apparatus 200 corrects the image on the basis of the correction data received from the terminal apparatus 100 is described in the abovementioned example, this is only an example.

That is, in the case in which the gray scale values of the image data are corrected through image processing for the image data, such an operation may also be performed in the external apparatus 100. In this case, the external apparatus 100 may transmit the image data of which the gray scale values are corrected to the display apparatus 200, and the display apparatus 200 may display the image data received from the external apparatus 100.

Meanwhile, although a case in which the test image of which the luminance is adjusted depending on the illuminance level sensed by the sensor 220 is displayed is described in the abovementioned example, this is only an example.

In detail, the processor 240 may control the display panel 210 to display a test image having a predetermined luminance regardless of the illuminance level sensed by the sensor 220. However, in the case in which the illuminance level sensed by the sensor 220 is a predetermined threshold value or more, the processor 240 may display a GUI including a specific message on the display panel 210.

In this case, the message may include a content for making the surrounding illumination dark, such as "Please make surrounding illumination dark for the purpose of accurate measurement".

That is, when the external apparatus 100 photographs the test image displayed on the display apparatus 200 to decide the regions having the non-uniform luminance in the display apparatus 200, the surrounding environment is made to be dark in that the regions having the non-uniform luminance in the display apparatus 200 in the test image may not be clearly distinguished due to the surrounding light sources of the display panel 210 in the case in which the surrounding light sources is bright.

Figure 8:
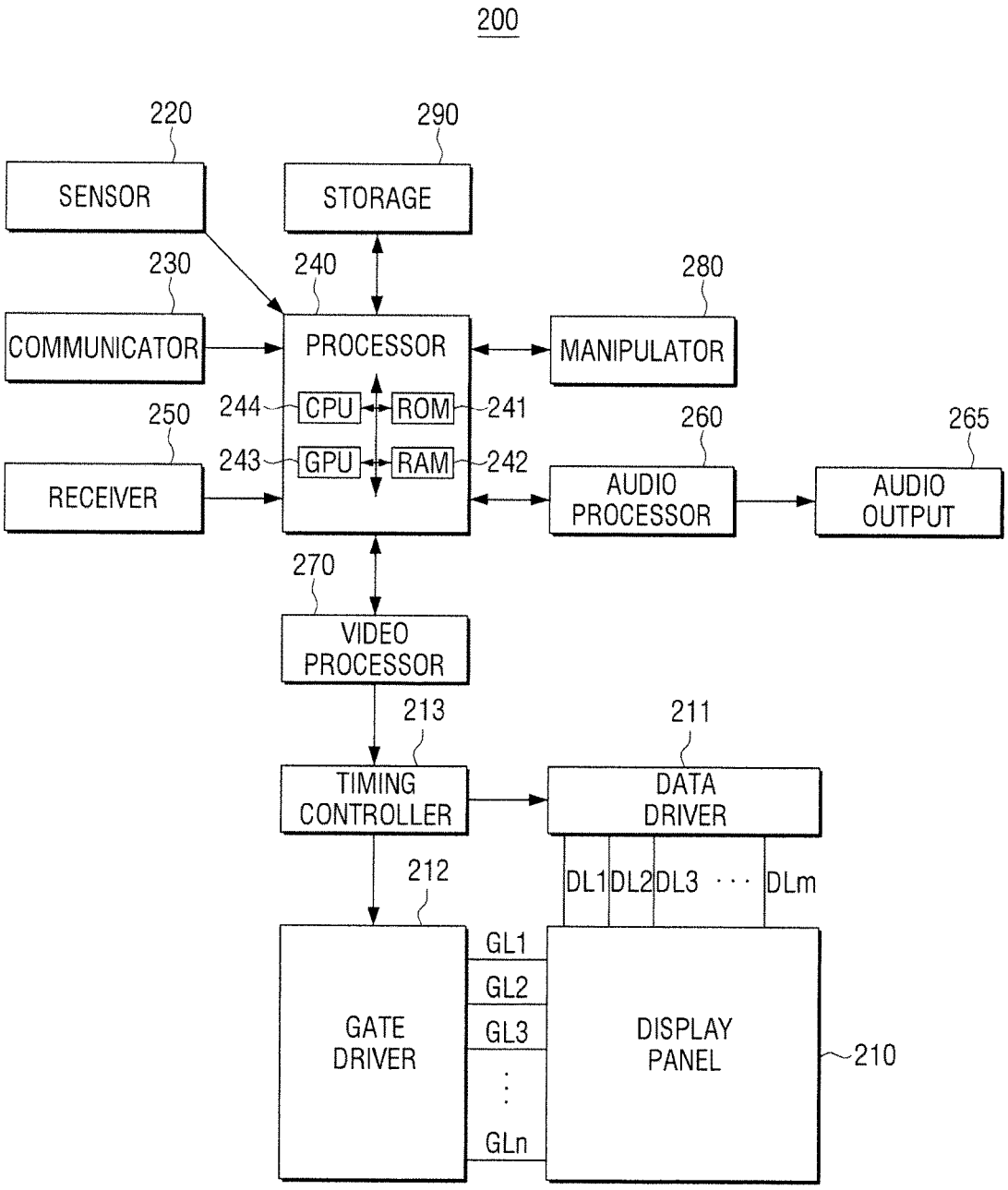

FIG. 8 is a block diagram for describing detailed components of the display apparatus according to an exemplary embodiment of the present disclosure.

Referring to FIG. 8, the display apparatus 200 includes the display panel 210, the data driver 211, the gate driver 212, the timing controller 213, the sensor 220, the communicator 230, the processor 240, a receiver 250, an audio processor 260, an audio output 265, a video processor 270, an manipulator 280, and a storage 290.

Meanwhile, since the display panel 210, the sensor 220, the communicator 230, the processor 240, and the timing controller 213 of FIG. 8 are the same as those of FIGS. 6 and 7, a detailed description for overlapping contents is omitted.

The receiver 250 receives broadcasting from broadcasting stations or satellites in a wired or wireless manner, and demodulates the received broadcasting. In detail, the receiver 250 may receive transmission streams through an antenna or a cable and demodulates the transmission streams to output digital transmission stream signals. In this case, the receiver 250 may be implemented in a form in which it includes components such as a tuner (not illustrated), a demodulator (not illustrated), and the like. However, this is only an example, and the receiver 250 may be implemented in various forms according to implementations.

The audio processor 260 may perform signal processing such as decoding, or the like, on audio data input from the receiver 250 and the storage 290, and output the audio data to a speaker 265.

The video processor 270 may perform signal processing such as decoding, or the like, on image data input from the receiver 250 and the storage 290, and output the image data to the timing controller 213.

Meanwhile, the audio processor 260 and the video processor 270 may be implemented by separate chips or be implemented by a single chip.

The manipulator 280 is implemented by a touch screen, a touch pad, a key button, a keypad, or the like, to provide a user manipulation of the display apparatus 200. Although an example in which control commands are received from the manipulator 280 provided in the display apparatus 200 is described in the present exemplary embodiment, the manipulator 280 may also receive the user manipulation from an external control apparatus (for example, a remote controller).

The storage 290 may store image contents. In detail, the storage 290 may receive and store image contents in which images and audios are compressed from the audio processor 260 and the video processor 270, and output the stored image contents to the audio processor 260 and the video processor 270 depending on a control of the processor 240. Meanwhile, the storage 290 may be implemented by a hard disk, a non-volatile memory, a volatile memory, or the like.

The timing controller 213 may include a microcomputer, or the like, to process the input image data and display the image data on the display panel 210.

For example, the timing controller 213 may include a demura module (not illustrated) correcting regions having non-uniform luminance in the display panel 210 using correction data, an adaptive color correction (ACC) module performing color characteristic compensation using gray scale values, a dynamic capacitance compensation (DCC) module performing response speed compensation of the display panel 210, a module dividing the image data depending on specifications and outputting timing control signals depending on driving timing required by the display panel 210, and the like.

The processor 240 may include a read only memory (ROM) 241, a random access memory (RAM) 242, a graphic processing unit (GPU) 243, a CPU 244, and a bus. The ROM 241, the RAM 242, the GPU 243, the CPU 244, and the like, may be connected to each other through the bus.

The CPU 244 accesses the storage 290 to perform booting using an operating system (O/S) stored in the storage 290. In addition, the CPU 244 may perform various operations using various programs, contents, data, and the like, stored in the storage 290. Since operations of the CPU 244 are the same as those of the processor 240 described above, a description for overlapping contents is omitted.

An instruction set for booting a system, or the like, is stored in the ROM 241. When a turn-on command is input to supply power to the display apparatus, the CPU 244 copies the O/S stored in the storage 290 to the RAM 242 depending on instructions stored in the ROM 241, and execute the O/S to boot the system. When the booting is completed, the CPU 244 copies various programs stored in the storage 290 to the RAM 242, and executes the programs copied to the RAM 242 to perform various operations.

The GPU 243 may create a screen including various objects such as an icon, an image, a text, and the like, when the booting of the display apparatus 200 is completed.

Meanwhile, in the abovementioned example, the processor 240 and the video processor 270 may be included in a main board, and the timing controller 213 may be included in a TCON board. However, this is only an example, and in the case in which the main board and the TCON board are implemented to be integrated with each other, processor 240, the video processor 270, and the timing controller 213 may be included in the same board.

Figure 9:
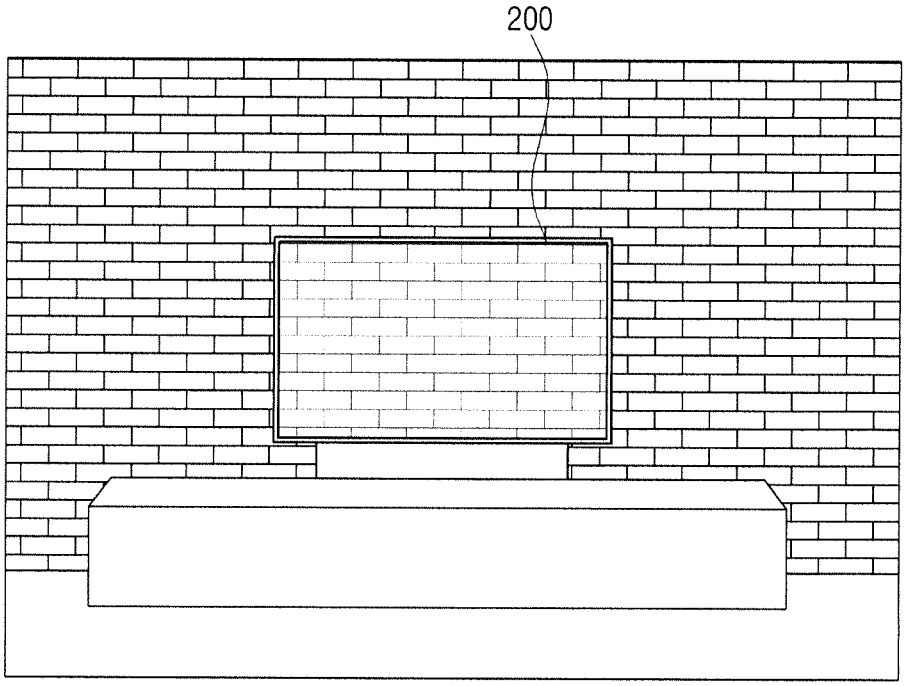
FIG. 9 is a view for describing operations of the display apparatus according to an exemplary embodiment of the present disclosure.

FIG. 9 is a view for describing operations of the display apparatus according to an exemplary embodiment of the present disclosure.

The display apparatus 200 according to an exemplary embodiment of the present disclosure has two operation modes. First, a first operation mode is a mode of displaying a general image. In detail, the first operation mode is a mode of displaying contents pre-stored in the display apparatus 200 or broadcasting received from an external apparatus using an entire screen of the display apparatus.

In addition, a second operation mode is a mode of displaying a background screen by the display apparatus 200 to allow a user not to easily recognize the display apparatus. Here, the background screen is a screen obtained by photographing a background in which the display apparatus is positioned, in advance, by the user.

In the case of the second operation mode as described above, the display apparatus 200 displays a rear background of the display apparatus and the background screen, and the user may thus mistake the display apparatus for a transparent glass window.

Meanwhile, in the second operation mode, a specific object as well as the background screen may be displayed. Here, the specific object may be a clock object, but various objects (for example, a picture, a photograph, a fish bowl, and the like) may be displayed as long as they may be attached to a general wall.

Figure 10:
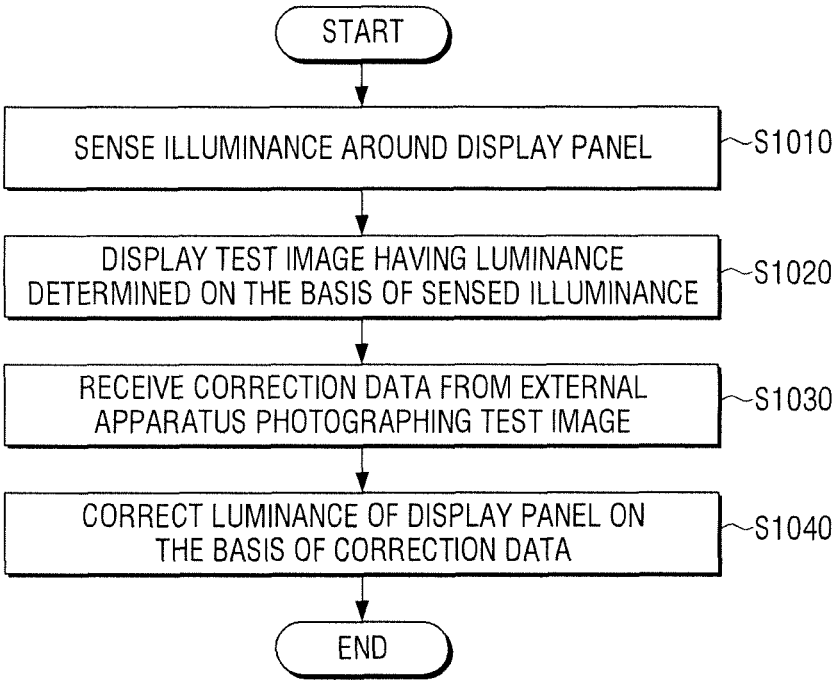
FIG. 10 is a flow chart for describing a display method of the display apparatus according to an exemplary embodiment of the present disclosure.

FIG. 10 is a flow chart for describing a display method of the display apparatus including the display panel according to an exemplary embodiment of the present disclosure.

The illuminance around the display panel is sensed (S1010), and the test image having the luminance determined on the basis of the sensed illuminance is displayed (S1020). Here, the test image may be a single color image including a plurality of markers. In the case, the plurality of markers may be displayed on corner portions of the test image.

Then, the correction data are received from the external apparatus photographing the displayed test image (S1030). Here, the correction data includes data on the correction gray scale values of the specific region of the display panel of the display apparatus.

Then, the luminance of the display panel is corrected on the basis of the correction data (S1040).

In this case, as the level of the sensed illuminance becomes high, the test image may be displayed at luminance that becomes relatively high.

Meanwhile, the external apparatus may divide the photographed test image into the plurality of regions, measure luminance of each of the plurality of regions, calculate the correction gray scale values required for the luminance measured in each region to be the target luminance, and transmit the data on the correction gray scale values to the display apparatus.

In addition, in S1040, the timing controller of the display apparatus may be controlled so that the gray scale values of the image data displayed on the specific region of the display panel are corrected on the basis of the correction gray scale values.

In addition, in S1040, the gray scale values of the image data displayed on the specific region of the display panel may be corrected on the basis of the correction gray scale values, and the image data of which the gray scale values are corrected may be displayed on the specific region.

In addition, in S1040, the luminance of the specific region of the display panel may be corrected by controlling the light sources of the backlight irradiating the light to the specific region of the display panel on the basis of the correction gray scale values.

In addition, the display methods according to the diverse exemplary embodiments described above may be implemented by a program and be provided to the display apparatus. Particularly, a problem including the display method may be stored and provided in a non-transitory computer readable medium.

The non-transitory computer readable medium is not a medium that stores data therein for a while, such as a register, a cache, a memory, or the like, but means a medium that semi-permanently stores data therein and is readable by a device. In detail, various applications or programs described above may be stored and provided in the non-transitory computer readable medium such as a compact disk (CD), a digital versatile disk (DVD), a hard disk, a Blu-ray disk, a universal serial bus (USB), a memory card, a read only memory (ROM), or the like.

Although the exemplary embodiments of the present disclosure have been illustrated and described hereinabove, the present disclosure is not limited to the abovementioned specific exemplary embodiments, but may be variously modified by those skilled in the art to which the present disclosure pertains without departing from the scope and spirit of the present disclosure as disclosed in the accompanying claims. These modifications should also be understood to fall within the scope of the present disclosure.

What is claimed is:

1. A display apparatus comprising:

a display panel;

a sensor;

a communicator configured to perform communication with an external apparatus; and at least one processor configured to:

based on a illuminance around the display panel being sensed by the sensor, determine a luminance of a test image for distinguishing a luminance corresponding to a specific region of the display panel from a luminance corresponding to another region of the display panel so that a higher sensed luminance respectively results in a higher determined luminance, control the display panel to display the test image with the determined luminance, receive, from an external apparatus, through the communicator, correction data that is identified based on a photograph being captured by the external apparatus from the display panel which is the displayed test image, correct a gray scale value of an image data corresponding to the specific region of the display panel based on the received correction data, and control the display panel to display the image data of which the gray scale value is corrected on the specific region of the display panel, wherein the test image is a single color image including a plurality of markers.

2. The display apparatus as claimed in claim 1, wherein the received correction data comprises a correction gray scale value of a specific region of the display panel.

3. The display apparatus as claimed in claim 2, wherein the correction gray scale value indicates a correction gray scale value required for luminance measured by the external apparatus in each region of a plurality of regions of the photograph to be a target illumination.

4. The display apparatus as claimed in claim 2, further comprising a timing controller configured to drive the display panel, wherein, to correct the luminance of the display panel, the at least one processor controls the timing controller so that the gray scale value of image data displayed on the specific region of the display panel is corrected on based on the correction gray scale value.

5. The display apparatus as claimed in claim 2, wherein, to correct the luminance of the display panel, the at least one processor corrects luminance of the specific region of the display panel by controlling a light source of a backlight to irradiate light to the specific region of the display panel based on the correction gray scale value.

6. The display apparatus as claimed in claim 1, wherein the plurality of markers are displayed on corner portions of the test image.

7. A display method of a display apparatus comprising a display panel, the display method comprising:

by at least one processor of the display apparatus:

sensing an illuminance around the display panel;

based on a illuminance around the display panel being sensed, determining a luminance of a test image for distinguishing a luminance corresponding to a specific region of the display panel from a luminance corresponding to another region of the display panel so that a higher sensed luminance respectively results in a higher determined luminance;

displaying the test image with the determined luminance on the display panel;

receiving, from an external apparatus, correction data that is identified based on a photograph being captured by the external apparatus from the display panel which is the displayed test image;

correcting a gray scale value of an image data corresponding to the specific region of the display panel on based on the received correction data; and displaying the image data of which the gray scale value is corrected on the specific region of the display panel, wherein the test image is a single color image including a plurality of markers.

8. The display method as claimed in claim 7, wherein the received correction data comprises a correction gray scale value of a specific region of the display panel.

9. The display method as claimed in claim 8, wherein the correction gray scale value indicates a correction gray scale value required for luminance measured by the external apparatus in each region of a plurality of regions of the photograph to be a target illumination.

10. The display method as claimed in claim 8, wherein the correcting the luminance of the display panel comprises controlling a timing controller of the display apparatus so that the gray scale value of image data displayed on the specific region of the display panel is corrected on the based on the correction gray scale value.

11. The display method as claimed in claim 8, wherein the correcting the luminance of the display panel comprises correcting luminance of the specific region of the display panel by controlling a light source of a backlight to irradiate light to the specific region of the display panel based on the correction gray scale value.

12. The display method as claimed in claim 7, wherein the displaying displays the test image with the plurality of markers on corner portions of the test image.

13. A display apparatus comprising:

a display panel;

a sensor; and at least one processor configured to:

based on a illuminance around the display panel being sensed by the sensor, determine a luminance of a test image that is proportional to the sensed illuminance for distinguishing a luminance corresponding to a specific region of the display panel from a luminance corresponding to another region of the display panel, control the display panel to display the test image with the determined luminance, receive, from an external apparatus, correction data that is identified based on a photograph being captured by the external apparatus from the display panel which is the displayed test image, correct a gray scale value of an image data corresponding to the specific region of the display panel based on the received correction data, and control the display panel to display the image data of which the gray scale value is corrected on the specific region of the display panel.

14. The display apparatus as in claim 13, wherein the test image is a single color image including a plurality of markers.

15. The display apparatus as in claim 13, wherein the at least one processor determines the luminance for the test image so that a higher sensed luminance respectively results in a higher determined luminance, the determined luminance thereby being proportional to the sensed illuminance.

16. The display apparatus as in claim 14, wherein the at least one processor determines the luminance for the test image so that a higher sensed luminance respectively results in a higher determined luminance, the determined luminance thereby being proportional to the illuminance around the display panel sensed by the sensor.

* * * * *